United States Patent [19]

Bertolami et al.

[11] Patent Number: 4,479,331

[45] Date of Patent: Oct. 30, 1984

[54] VINYL CLAD WOOD CONSTRUCTION REPLACEMENT SASH WINDOWS

[75] Inventors: Ugo Bertolami, Somerville; Salvatore Bertolami, Burlington, both of Mass.

[73] Assignee: J. B. Sash & Door Co. Inc., Somerville, Mass.

[21] Appl. No.: 339,289

[22] Filed: Jan. 15, 1982

[51] Int. Cl.[3] ..... E04B 1/04

[52] U.S. Cl. ..... 49/404; 52/204; 52/217; 52/727

[58] Field of Search ..... 49/DIG. 1, 501, 504, 49/404; 52/204, 211, 770, 212, 213, 217, 727, 725, 724, 309.13, 309.15

[56] References Cited

U.S. PATENT DOCUMENTS

| | | | |
|---|---|---|---|
| 3,386,209 | 6/1968 | Starcevic | 49/501 |
| 3,491,584 | 1/1970 | Selzer | 52/727 |
| 3,591,985 | 7/1971 | Coppins | 49/504 |
| 3,662,494 | 5/1972 | Sitterly | 49/504 |
| 3,815,285 | 6/1974 | Kuyper | 49/501 |
| 4,154,033 | 5/1979 | Krueger | 52/773 |
| 4,158,934 | 1/1979 | Olsen | 49/501 |
| 4,207,707 | 6/1980 | Holdiman | 49/504 |
| 4,328,644 | 5/1982 | Scott | 49/501 |

FOREIGN PATENT DOCUMENTS

| | | | |
|---|---|---|---|
| 661020 | 4/1963 | Canada | 52/773 |

*Primary Examiner*—Henry E. Raduazo

*Attorney, Agent, or Firm*—Morse, Altman & Dacey

[57] ABSTRACT

The present invention provides (1) a sash window assemblage having basic wood construction with selectively milled kerfs and (2) exterior vinyl cladding in the form of vinyl extrusions of particular configuration. These vinyl extrusions, in cross section, feature facing portions that lie snugly against front and edge surfaces of the rails and stiles of a window sash, gripping portions that snap and lock into the kerfs, sealing portions that squeeze tightly against the rigid elements they contact, and spline portions that extend upwardly and downwardly. The spline portions can be cut readily for conformation with an out-of-plumb frame. The facing and gripping portions have sufficiently great cross sectional thickness to impart rigidity. At least sections of the sealing portions have appropriate composition and sufficiently small cross sectional thickness to impart flexibility.

10 Claims, 18 Drawing Figures

VINYL CLAD WOOD CONSTRUCTION REPLACEMENT SASH WINDOWS

BACKGROUND

1. Field of the Invention

The present invention relates to wooden window sashes and, more particularly, to double-hung wooden window sashes having (1) exterior surfaces that are clad with vinyl and (2) interior surfaces that can be stained or painted.

2. The Prior Art

A need has developed for modern replacement window sash assemblages that can be fitted into prior existing window openings from which old and worn window sash assemblages have been removed. It often is desired that such replacement window sash assemblages combine the advantages of (1) exterior surfaces that provide the durable qualities of vinyl, (2) construction that provides the insulating qualities of wood, and (3) interior surfaces that can be decorated as desired. However, old window openings often are of out-of-plumb and it has been difficult to design semi-custom or off-the-shelf window sash assemblages with clad vinyl exterior surfaces for convenient insertion into such old window openings while maintaining desirable visual integrity and weather tightness.

BRIEF SUMMARY OF THE PREFERRED EMBODIMENT

The primary object of the present invention is to provide a sash window assemblage having (1) wood construction with selectively milled kerfs and (2) exterior vinyl cladding in the form of vinyl extrusions of particular configuration. These vinyl extrusions, in cross section, feature facing portions that lie snugly against front and edge surfaces of the rails and stiles of a window sash, gripping portions that snap and lock into the kerfs, sealing portions that squeeze tightly against rigid elements that they contact, and upwardly and downwardly extending splines that can be readily cut to conform the assemblage to an out-of-plumb frame. The facing and gripping portions have sufficiently great cross sectional thickness to impart rigidity. At least sections of the sealing portions have appropriate composition and sufficiently small cross sectional thickness to impart flexibility. The rigid portions are of relatively limited resilience for macrosposic deformation that enables snapping and locking into place. The flexible portions are of relatively great resilience for microscropic deformation that enables incremental conformation with the surfaces of the elements against which they squeeze.

Other objects of the present invention will in part be obvious and will in part appear hereinafter.

BRIEF DESCRIPTION OF THE DRAWINGS

For a fuller understanding of the nature and objects of the present invention, reference is made to the following specification, which is to be read in reference to the accompanying drawings wherein.

DETAILED DESCRIPTION OF THE PREFERRED EMBODIMENT

Figure 3:
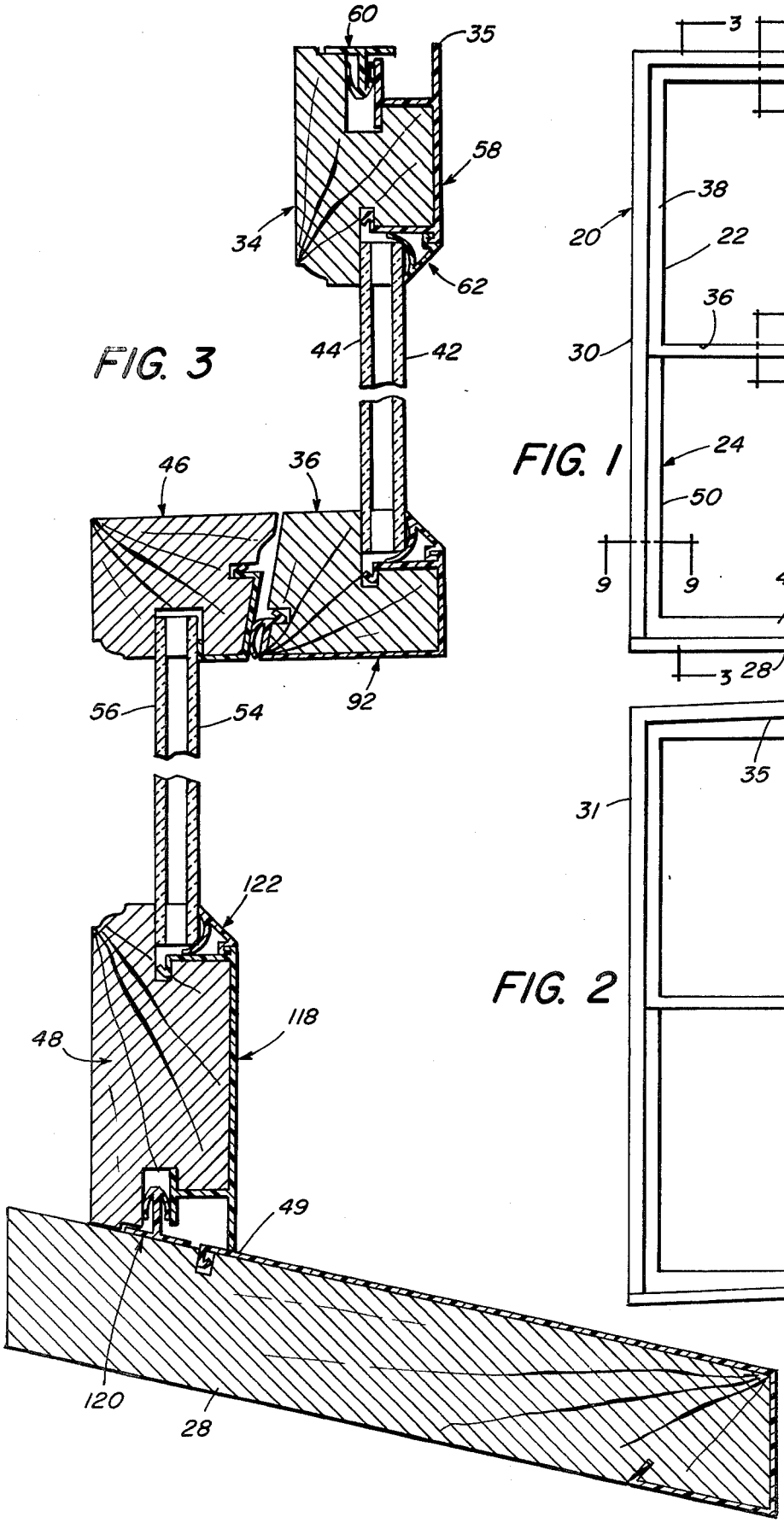
FIG. 3 is an enlarged cross sectional view of a part of the assemblage of FIG. 1, taken substantially along the lines 3—3 of FIG. 1.
Figure 1:
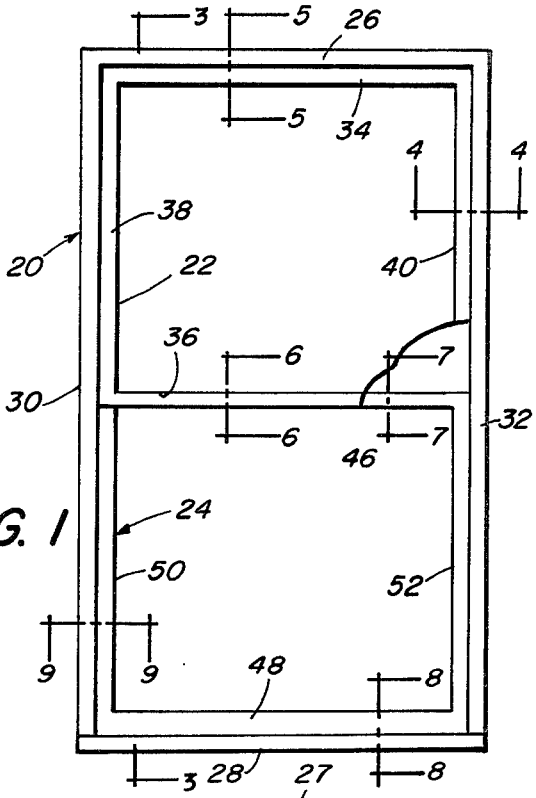
FIG. 1 is a front view of a wood construction, replacement, double-hung window sash assemblage embodying the present invention.
Figure 2:
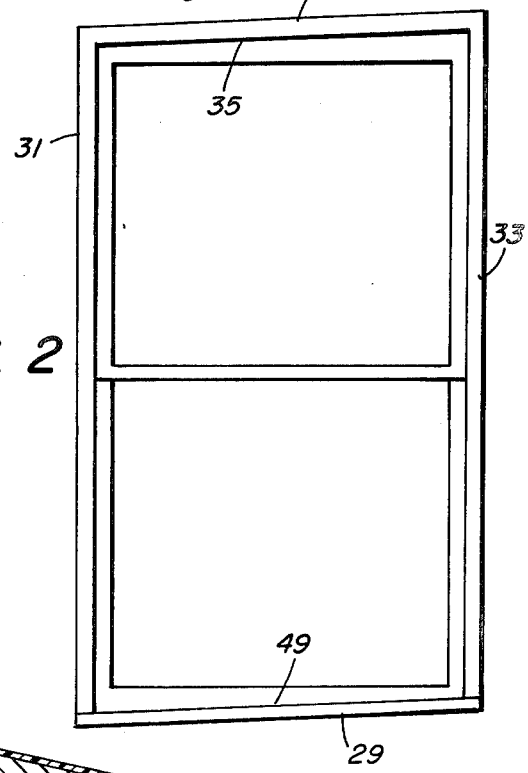
FIG. 2 is a front view of an out-of-plumb wood construction, replacement, double-hung window sash assemblage embodying the present invention.
Figure 4:
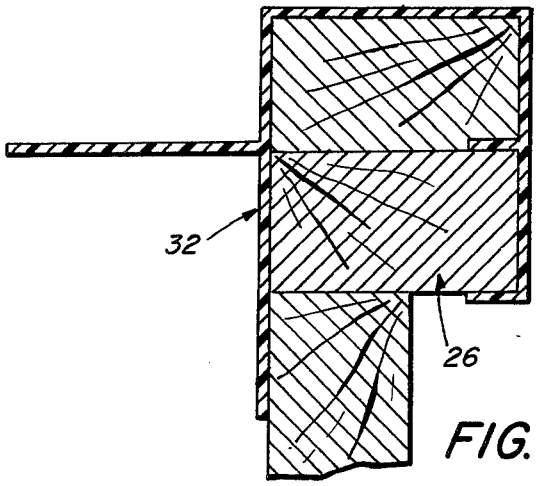
FIG. 4 is a cross sectional view of a part of the frame of the assemblage of FIG. 1, taken substantially along the lines 4—4 of FIG. 1.

The assemblage illustrated in FIG. 1 comprises a frame 20, an upper window sash 22, and a lower window sash 24. Frame 20 includes a header portion 26, a sill portion 28, and jamb portions 30 and 32. A cross section of sill portion 28 is shown in FIG. 3. A cross section of head and jamb portions 26, 30, and 32 is shown in FIG. 4. Upper sash 22 includes a top rail 34, a forward meeting rail 36, and a pair of stiles 38 and 40, which hold a double glass pane including an outer glass pane 42 and an inner glass pane 44. Lower sash 24 includes a rearward meeting rail 46, a bottom rail 48, and a pair of stiles 50 and 52, which hold a double glass pane assemblage including an outer glass pane 54 and an inner glass pane 56. In accordance with the present invention, the aforementioned components are constructed of wood that is clad with associated with extrusions, which will be described in detail below. The arrangement specifically is such that top rail 34 of upper window sash 22 and bottom rail 48 of lower window sash 24, respectively, have clad vinyl extrusions that are characterized by upwardly extending splines on the top rail and downwardly extending splines on the bottom rail. These splines can be cut easily to conform the sashes to an out-of-plumb frame, but nevertheless can maintain excellent weather tightness by intimate contact with the head and the sill of the frame assemblage. This feature is illustrated in exaggerated fashion in FIG. 2, wherein an out-of-plumb frame is shown as having essentially vertical jamb portions 31 and 33 and parallel but oblique head and sill portions 27 and 29. It will be observed that the upper rim 35 of the top rail and the lower rim of bottom rail are cut in parallel at oblique angles with respect to the horizontal edges of the window panes and the vertical edges of jamb portions 31 and 33. However, the upper edges of the upper window sash and the lower edges of the lower window sash conform precisely to the surfaces of the head and sill, respectively.

Figure 5:
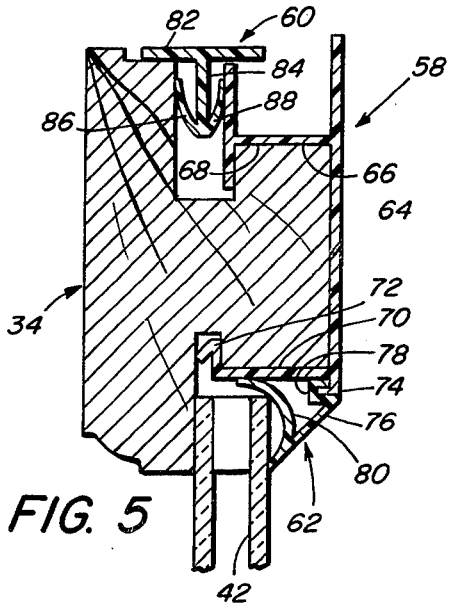
FIG. 5 is a cross sectional view of the top rail of the assemblage of FIG. 1, taken substantially along the lines 5—5 of FIG. 1.
Figure 11:
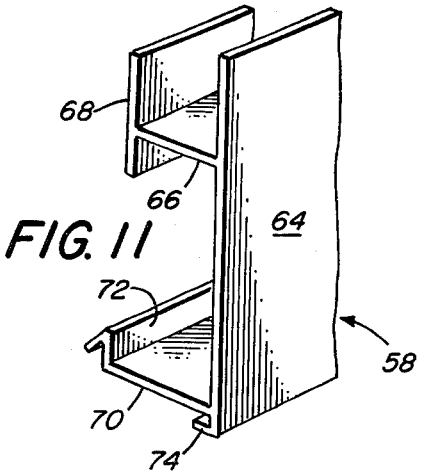
FIG. 11 is a perspective view, partly broken away, of a component of the assemblage as shown in FIG. 5.

Connected to top rail 34 of upper window sash 22 are: a top rail extrusion 58, to be described now; and a top weather strip extrusion 60 and a glass bead extrusion 62, to be described below. As is best shown in FIGS. 5 and 11, top rail extrusion 58, in cross section, includes a forward face portion 64, a medial flange portion 66 extending rearwardly from the face portion, a cross portion 68 at the inner extremity of flange portion 66 and extending in opposite directions therefrom, a lower peripheral flange portion 70 extending rearwardly from forward face portion 64, an inner hook portion 72 extending upwardly and reversely from the inner extremity of peripheral flange portion 70, and a peripheral hook portion 74 extending downwardly beyond peripheral flange portion 70. Top rail 34 has kerfs against and into which portions 64, 66, 68, 70 and 72 are first flexed and then snapped. All of the aforementioned portions are composed of vinyl essentially the same thickness, which is sufficient to impart substantial rigidity. In accordance with the present invention, the sections of face portion 64 and cross portion 68 extending upwardly beyond medial flange portion 66 constitute splines that can be cut to conform to an out-of-plumb frame.

Glass bead extrusion 62, in cross section, includes a diagonal body portion 76, a forward peripheral reverse hook portion 78 at the outer extremity of body portion 76, and a rearward reverse arcuate portion 80 extending from the inner extremity of body portion 76. Portions 76, 78 and 80 are composed of vinyl of essentially the same thickness, which is sufficient to impart substantial rigidity. It will be observed that when extrusion 62 is in operative position, hook portion 78 interconnects with hook portion 74 of top rail extrusion 58 and reverse actuate portion 80 is flexed between the edge of front pane 42 and peripheral flange portion 70 of top rail extrusion 58, the result being a weather tight seal about the glass pane assemblage.

Top weather strip extrusion 60 includes a body portion 82, a downwardly directed flange portion 84 extending immediately from the body portion, and a pair of reversely directed grappling portions 86 and 88 extending upwardly from the inner extremity of the flange portion. Body portion 82 and flange portion 84 are at right angles with respect to each other in order that the body portion rest snugly against the head portion of the frame. Body portion 82 and flange portion 84 are composed of vinyl of essentially of the same thickness, which is sufficient to impart substantial rigidity. On the other hand, grappling portions 86 and 88, also composed of vinyl, are of substantially lesser thickness whereby they essentially are flexible rather than rigid. When in position, extrusion 60 serves as a closure for providing a finished top and ensuring a good weather seal between the top rail and the frame.

Figure 6:
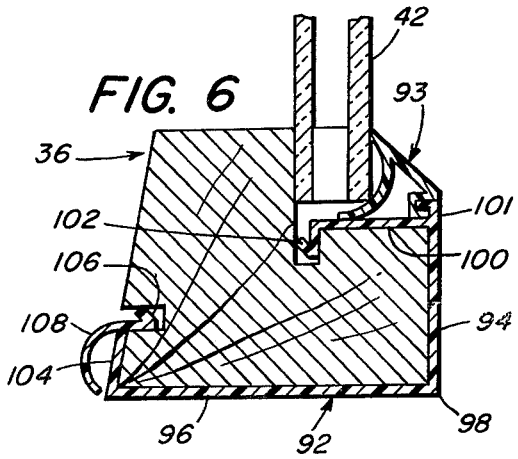
FIG. 6 is a cross sectional view of the forward meeting rail of the assemblage of FIG. 1, taken substantially along the lines 6—6 of FIG. 1.
Figure 13:
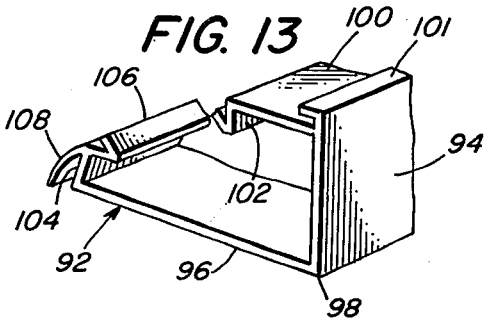
FIG. 13 is a perspective view, partly broken away, of a component of the assemblage as shown in FIG. 6.

Connected to forward meeting rail 36 is a forward meeting rail extrusion 92, to be described now, and a glass bead extrusion 93, to be described below. As is best shown in FIGS. 6 and 13, forward meeting rail extrusion 92, in cross section, includes a forward face portion 94 and a bottom face portion 96 meeting at a lower front edge 98, an upper peripheral flange portion 100 extending inwardly from face portion 94, a reverse peripheral hook portion 101 extending upwardly from face portion 94, a reverse inner hook portion 102 extending downwardly from the inner extremity of peripheral flange portion 100, an inner peripheral flange portion 104 extending upwardly and forwardly from the inner extremity of bottom face portion 96, a reverse hook portion 106 extending forwardly from the upper extremity of flange portion 104, and a depending arcuate portion 108 extending downwardly from the upper extremity of flange portion 104. Portions 94, 96, 100, 101, 102, 104, and 106 are composed of vinyl of essentially the same thickness, which is sufficient to impart substantial rigidity. On the other hand, acruate portion 108 is of a reduced thickness and of an elastomeric, preferably vinyl, composition, which imparts substantially rubber-like characteristics. Forward meeting rail 36 has kerfs in its wood construction against and into which portions 94, 96, 100, 102, and 104 are first flexed then snapped.

Glass bead extrusion 93 is like glass bead extrusion 62 in composition and configuration, being such that, in cross section, its body portion is oblique, its outer hook portion interconnects with hook portion 101 of forward meeting rail 36, and its reverse arcuate portion is flexed between the edge of front pane 42 and peripheral flange portion 100. The body portion, as shown in FIG. 6, faces generally upwardly.

Figure 8:
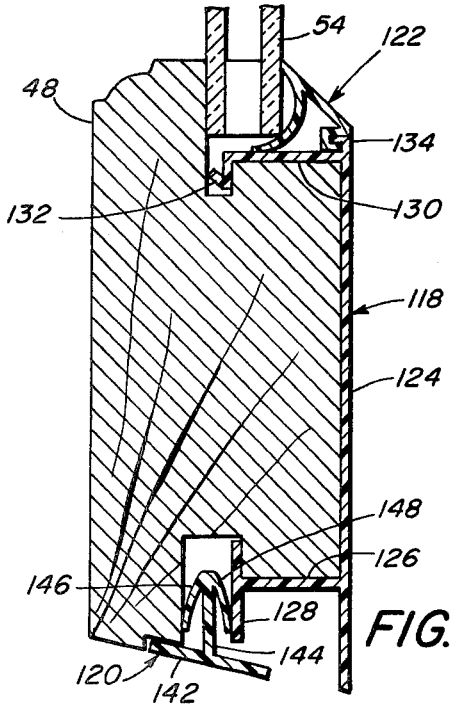
FIG. 8 is a cross sectional view of the bottom rail of the assemblage of FIG. 1, taken substantially along the lines 8—8 of FIG. 1.
Figure 9:
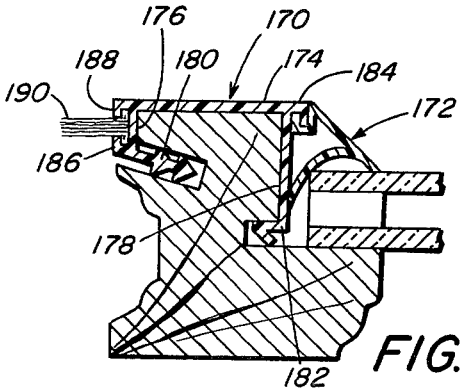
FIG. 9 is a cross sectional view of a stile of the assemblage of FIG. 1, taken substantially along the lines of 9—9 of FIG. 1.
Figure 10:
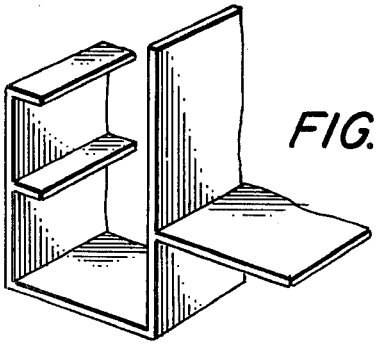
FIG. 10 is a perspective view, partly broken away, of a component of the assemblage as shown in FIG. 4.
Figure 15:
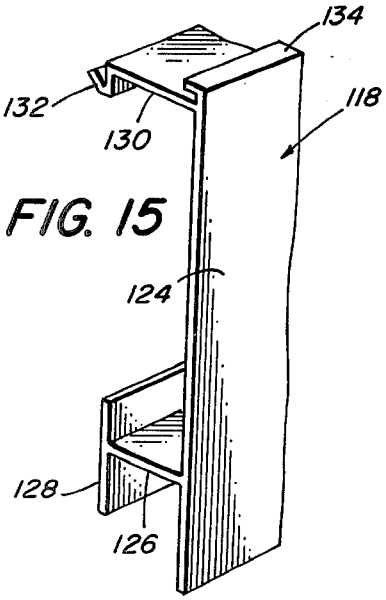
FIG. 15 is a perspective view, partly broken away, of a component of the assemblage as shown in FIG. 8.
Figure 12:
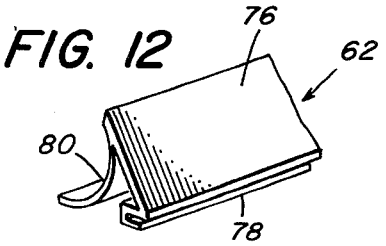
FIG. 12 is a perspective view, partly broken away, of a component of the assemblage as shown in FIGS. 5, 6, 8 and 9.
Figure 16:
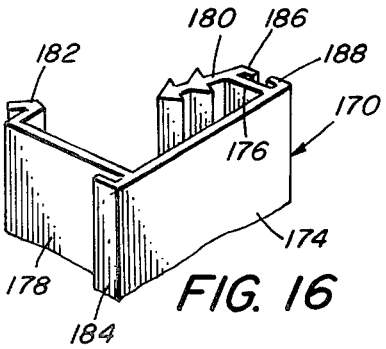
FIG. 16 is a perspective view, partly broken away, of a component of the assemblage as shown in FIG. 9
Figure 17:
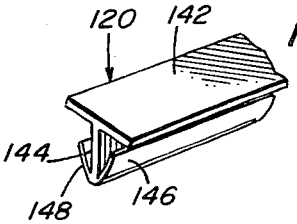
FIG. 17 is a perspective view, partly broken away, of a component of the assemblage as shown in FIG. 8.
Figure 18:
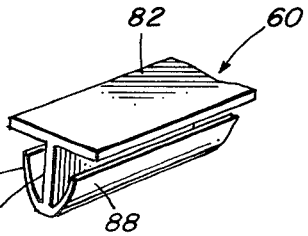
FIG. 18 is a perspective view, partly broken away, of a component of the assemblage as shown in FIG. 5.

Connected to bottom rail 48 of lower window sash 24 are: a bottom rail extrusion 118, to be described now; and a bottom weather strip extrusion 120 and a glass bead extrusion 122, to be described below. As is best shown in FIGS. 8 and 15, bottom rail extrusion 118, in cross section, includes a forward flange portion 124, a lower medial flange portion 126 extending rearwardly from the face portion, a cross portion 128 at the inner extremity of flange portion 126 and extending in opposite directions therefrom, an upper peripheral flange portion 130 extending rearwardly from face portion 124, an inner hook portion 132 extending downwardly and reversely from the inner extremity of peripheral flange portion 130, and an upper peripheral hook portion 134 extending upwardly beyond peripheral flange portion 130. Bottom rail 48 has kerfs against and into which portions 124, 126, 128, 130, and 132 are first flexed and then snapped. All of the aforementioned portions are composed of vinyl of essentially the same thickness, which is sufficient to impart substantial rigidity. In accordance with the present invention, the sections of face portion 124 and cross portion 128 extending downwardly beyond medial flange portion 126 constitute splines that can be cut to conform to an out-of-plumb frame.

Glass bead extrusion 122, includes a diagonal body portion, a peripheral reverse hook portion at the outer extremity of the body portion, and a reverse arcuate portion extending from the inner extremity of body portion, all analogous to their counterparts in extrusion 62. These portions are composed of vinyl of essentially same thickness, which is sufficient to impart substantial rigidity. It will be observed that, when this extrusion is operative, its reverse hook portion interconnects with peripheral hook portion 134 and its reverse arcuate portion is flexed between the edge of front pane 54 and peripheral flange portion 130, the result being a weather tight seal about the glass pane assemblage.

Bottom weather strip extrusion 120 includes a body portion 142, an upwardly directed flange portion 144 extending intermediately from the body portion, and a pair of reversely directed grappling portions 146 and 148 extending downwardly from the inner extremity of the flange portion. Body portion 142 and flange portion 144 are at oblique angles with respect to each other in order that the body portion rest snugly on the sill. Body portion 142 and inward flange portion 144 are composed of vinyl of essentially of the same thickness, which is sufficient to impart substantial rigidity. On the other hand, grappling portions 146 and 148 are of substantially lesser thickness whereby they essentially are flexible rather than rigid. When in operative position, extrusion 120 serves as a closure for providing a finished appearance and a weather tight seal between the bottom rail and the frame.

Figure 7:
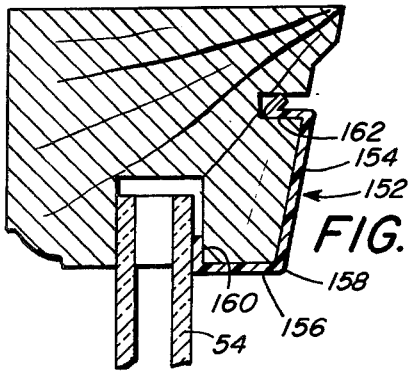
FIG. 7 is a cross sectional view of the rearward meeting rail of the assemblage of FIG. 1, taken substantially along the lines 7—7 of FIG. 1.
Figure 14:
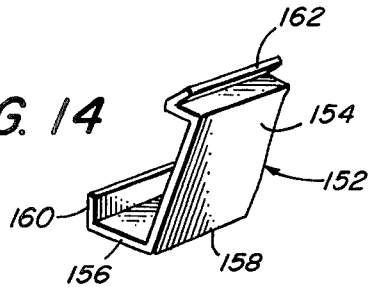
FIG. 14 is a perspective view, partly broken away, of a component of the assemblage as shown in FIG. 7.

Connected to meeting rail 46 is a rearward meeting rail extrusion 152. As is best shown in FIGS. 7 and 14, rearward meeting rail extrusion 152, in cross section, includes a forward face portion 154 and a bottom face portion 156 meeting at a lower front edge 158, a lower peripheral flange portion 160 extending upwardly from the bottom face portion 156, and an upper reverse hook portion 162 extending inwardly from the upper periphery of forward face portion 154. Portions 154, 156, 160, and 162 are composed of vinyl of essentially the same thickness, which is sufficient to impart substantial rigidity. Rearward meeting rail 46 has kerfs in its wood construction against and into which portions 154, 156, 160, and 162 are first flexed and then snapped.

Associated with stiles 38, 40, 50, and 52 of the upper and lower sashes are a plurality of stile extrusions, one of which is shown at 170, and a plurality glass bead extrusions, one of which is shown at 172. Stile extrusion 170, in cross section, includes a forward face portion 174, an outer peripheral flange portion 176 extending rearwardly from the outer edge of the face portion, and an inner peripheral flange portion 178 extending rearwardly from the inner edge of the face portion. Diagonally and inwardly extending from the rearward edge of outer flange portion 176 is a reverse catch portion 180. Inwardly extending from flange portion 178 is a hook portion 182. At the inner periphery of front portion 174 inwardly beyond flange portion 178 is a reverse hook portion 184. At the outer periphery of front portion 174 are a pair of opposed grip portions 186 and 188, which, in effect, are outward extensions of catch portion 180 and front portion 188, respectively. Grip portions 186 and 188 normally carry a felt strip 190. Portions 174, 176, 178, 180, 182, 184, 186, and 188 are composed of vinyl of essentially the same thickness, which is sufficient to impart substantial rigidity. Each stile has kerfs in its wood construction against and into which portions 174, 176, 178, 180, 182, and 184 are first flexed and then snapped.

Glass bead extrusion 172, in cross section, includes a diagonal body portion, a peripheral reverse hook portion at the forward extremity of the body portion, and a reverse arcuate portion extending from the rearward extremity of the body portion. It will be observed that, when this extrusion is operative, its reverse hook portion interconnects with peripheral hook portion 184 and its reverse arcuate portion is flexed between the edge of one of the front glass panes and inward peripheral flange 178. The portions of glass bead extrusion 172 are composed of vinyl of essentially the same thickness, which is sufficient to impart substantial rigidity.

SPECIFIC EXAMPLE

Preferably, the thickness of the various rigid vinyl portions of the window sash components, particularly the spline portions, ranges from 0.020 to 0.070 inch and the flexible portions are selected for their compatibility, both in mechanical dimension and chemical composition, with the rigid vinyl portions. In the present embodiment, the preferred cross sectional dimensions of the portions of the various window sash components are as follows: stile extrusion—0.040 to 0.045 inch; rearward meeting rail extrusion—0.040 to 0.045 inch; bottom rail extrusion—0.040 to 0.050 inch; forward meeting rail extrusion—0.040–0.045 inch; top weather strip extrusion—0.050 to 0.055; top rail extrusion—0.040 to 0.045 inch; glass bead extrusion—0.028–0.032 inch; bottom weather strip extrusion—0.050 to 0.055 inch.

OPERATION

In operation, the vinyl extrusions are flexed and snapped into position against the wooden faces, against the glass edges, against the vinyl faces, and into the kerfs with which they are associated. The arrangement is such that no cement exists or is needed between the wood construction and the vinyl extrusions. The top and bottom stiles are cut obliquely to conform to the head and sill portions of the frame and the window sashes are hung in the frame in association with conventional pulleys and weights. The exterior vinyl faces of the window sashes present a weather resistant finish and the interior wooden faces of the window sashes are decorated as desired by staining or painting to provide a decorative interior finish.

Since certain changes may be made in the foregoing disclosure without departing from the scope of the invention herein involved, it is intended that all matter described in the foregoing specification and shown in the accompanying drawings, be interpreted in an illustrative and not in a limiting sense.

What is claimed is:

1. A window assemblage comprising: an upper window sash and a lower window sash; said upper window sash including a top rail, a pair of upper stiles, and a forward meeting rail; said lower window sash including a bottom rail, a pair of lower stiles, and a rearward meeting rail; upper and lower glass panes carried by the upper and lower window sashes; said top rail, said pair of upper stiles, and said forward meeting rail, and said bottom rail, said pair of lower stiles, and said rearward meeting rail being of wood construction with selectively milled kerfs and exterior cladding in the form of a plurality of vinyl main extrusions and vinyl bead extrusions; said plurality of said main extrusions, in cross section, integrally including face portions and peripheral hook portions; said plurality of bead extrusions, in cross section, integrally including arcuate portions, oblique portions, and hook portions; a plurality of said hook portions of said bead extrusions being interconnected with a plurality of said hook portions of said main extrusions; and a plurality of said arcuate portions being flexed between edges of said glass panes and portions of said main extrusions, said plurality of main extrusions including upwardly and downwardly directed splines that are operative when cut obliquely to establish weather tight seals in association with non-plumb frames.

2. The assemblage of claim 1 wherein one of said main extrusions is a top rail extrusion including a forward face portion, a medial flange portion extending rearwardly from said face portion, a cross portion at the inner extremity of said flange portion and extending in opposite directions therefrom, a lower peripheral flange portion extending rearwardly from said forward face portion, an inner hook portion extending upwardly and reversely from the inner extremity of said peripheral flange portion, and a peripheral hook portion extending downwardly beyond said peripheral flange portion, said portions of said top rail extrusion being composed of vinyl essentially of the same thickness, which is sufficient to impart substantial rigidity.

3. The assemblage of claim 1 wherein one of said main extrusions is a forward meeting rail extrusion including a forward face portion and a bottom face portion meeting at a lower front edge, an upper peripheral flange portion extending inwardly from said front portion, a reverse peripheral hook portion extending upwardly from said face portion, a reverse hook portion extending downwardly from the inner extremity of said peripheral flange portion, an inner peripheral flange portion extending upwardly and forwardly from the inner extremity of said bottom portion, a reverse hook portion extending forwardly from the upper extremity of said flange portion, and a depending arcuate portion extending downwardly from the upper extremity of said flange portion, said arcuate portion being rubber-like.

4. The assemblage of claim 1 wherein one of said main extrusions is a rearward meeting rail extrusion including a forward face portion and a bottom face portion meeting at a lower front edge, a lower peripheral flange portion extending upwardly from said bottom face portion, and a reverse hook portion extending inwardly from the upper periphery of said outer face portion.

5. The assemblage of claim 1 wherein one of said main extrusions is a bottom rail extrusion including a forward face portion, a medial flange portion extending rearwardly from said face portion, a cross portion at the inner extremity of said flange portion and extending in opposite directions therefrom, an upper peripheral flange portion extending rearwardly from said forward face portion, an inner hook portion extending downwardly and reversely from the inner extremity of said peripheral flange portion, and a peripheral hook portion extending upwardly beyond said peripheral flange portion, said portions of said extrusion being composed of vinyl essentially of the same thickness, which is sufficient to impart substantial rigidity.

6. The assemblage of claim 1 wherein one of said main extrusions is a stile extrusion including a forward face portion, an outer peripheral portion extending rearwardly from the outer edge of said face portion, an inner peripheral flange portion extending rearwardly from the inner edge of said face portion, a reverse catch portion extending diagonally and inwardly from the rearward edge of said outer flange portion, a hook portion extending from said inner peripheral flange portion, and a reverse hook portion at the inner periphery of said front portion extending inwardly beyond said flange portion.

7. The assemblage of claim 1 wherein one of said extrusions is a weather strip extrusion including a body portion, an inwardly directed flange portion depending intermediately from said body portion, and a pair of reversely directed grappling portions extending from the inner extremity of said flange portion, said body portion and said flange portion being at substantially right angles with respect to each other in order that the body portion rest snugly against the head portion of a frame, said body portion and said flange portion being of essentially the same thickness, which is sufficient to impart substantial rigidity, said grappling portions being of substantially lesser thickness whereby they essentially are flexible.

8. The assemblage of claim 1 wherein one of said extrusions is a weather strip extrusion including a body portion, an inwardly directed flange portion extending intermediately from said body portion, and a pair of reversely directed grappling portions extending from the inner extremity of said flange portion, said body portion and said flange portion being at substantially oblique angles with respect to each other in order that the body portion rest snugly against the sill portion of a said frame, said body portion and said flange portion being of essentially the same thickness, which is sufficient to impart substantial rigidity, said grappling portions being of substantially lesser thickness whereby they essentially are flexible.

9. A window assemblage comprising: a frame; an upper window sash and a lower window sash; said upper window sash including a top rail, a pair of upper stiles, and a forward meeting rail; said lower window sash including a bottom rail, a pair of lower stiles and a rearward meeting rail; upper and lower glass panes carried by the upper and lower window sashes; said top rail, said pair of upper stiles, and said forward meeting rail being of wood construction with selectively milled kerfs and exterior cladding in the form of a plurality of vinyl main extrusions and vinyl bead extrusions; said bottom rail, said pair of lower stiles, and said rearward meeting rail being of wood construction with selectively milled kerfs and exterior cladding in the form of a plurality of vinyl main extrusions and vinyl bead extrusions; said plurality of said main extrusions, in cross section, integrally including face portions and peripheral hook portions; said plurality of bead extrusions, in cross section, integrally including arcuate portions, oblique portions, and hook portions; a plurality of said hook portions of said bead extrusions being interconnected with a plurality of said hook portions of said main extrusions; and a plurality of said arcuate portions being flexed between edges of said glass panes and portions of said main extrusions, said frame being out-of-plumb, said plurality of vinyl main extrusions including upwardly and downwardly directed splines that are operative when cut obliquely to establish weather tight seals in association with said frame.

10. An extrusion for facing a wood window sash, said extrusion being a top rail extrusion including a forward face portion, a medial flange portion extending rearwardly from said face portion, a cross portion at the inner extremity of said flange portion and extending in opposite directions therefrom, a lower peripheral flange portion extending rearwardly from said forward face portion, an inner hook portion extending upwardly and reversely from the inner extremity of said peripheral flange portion, and a peripheral hook portion extending downwardly beyond said peripheral flange portion, said portions of said top rail extrusion being composed of vinyl essentially of the same thickness, which is sufficient of impart substantial rigidity.

* * * * *